United States Patent [19]

Williams

[11] 4,420,914

[45] Dec. 20, 1983

[54] SPHERICAL SEGMENT EDGE ATTACHMENT

[75] Inventor: W. Wayne Williams, Westwood, Calif.

[73] Assignee: The United States of America as represented by the Secretary of the Air Force, Washington, D.C.

[21] Appl. No.: 324,342

[22] Filed: Nov. 23, 1981

[51] Int. Cl.[3] ..... E04F 15/14

[52] U.S. Cl. ..... 52/80; 52/400; 220/213; 114/66

[58] Field of Search ..... 52/80, 397, 400, 200, 52/86; 114/66, 314; 220/213, 315, 240; 350/252, 253, 249

[56] References Cited

U.S. PATENT DOCUMENTS

| | | | |
|---|---|---|---|
| 2,784,926 | 3/1957 | Bonza | 52/400 |
| 3,340,656 | 9/1967 | Mathieu | 52/200 |
| 3,397,503 | 8/1968 | Adler | 220/5 A |
| 3,450,082 | 6/1969 | DeMarest, Jr. | 114/16 |
| 3,555,663 | 1/1971 | Forman | 29/463 |
| 3,757,725 | 9/1973 | Horn | 114/173 |
| 3,962,951 | 6/1976 | Schenk | 89/1.81 |
| 4,132,218 | 1/1979 | Bennett | 52/397 |
| 4,204,374 | 5/1980 | Olson | 52/397 |

*Primary Examiner*—John E. Murtagh
*Assistant Examiner*—Henry E. Raduazo
*Attorney, Agent, or Firm*—Donald J. Singer; Bobby D. Scearce

[57] ABSTRACT

An improved peripheral closure joint for sealing spherical shell segments to a supporting structure therefor is provided which comprises a generally frustoconical member having an annular groove on the smaller circumference thereof for receiving the peripheral edge of the shell segment and means on the outer periphery thereof for engaging the supporting structure without slippage, said means including a plurality of annular corrugations on the peripheral edge of said frustoconical member and mating corrugations on a supporting surface of said structure to allow said member limited rolling engagement with said surface as said member flexes under an applied load. The frustoconical member is preferably configured to transmit the applied load substantially perpendicular to said surface, and tangent to the spherical shell.

3 Claims, 2 Drawing Figures

SPHERICAL SEGMENT EDGE ATTACHMENT

RIGHTS OF THE GOVERNMENT

The invention described herein may be manufactured and used by or for the Government of the United States for all governmental purposes without the payment of any royalty.

BACKGROUND OF THE INVENTION

This invention relates to the field of structures supporting spherical enclosures and more particularly to improved load bearing edge attachments or peripheral closure joints for spherical shell segments.

Spherical shell segment closure structures finding substantial prior use in a wide range of applications include domed building structures, view ports for deep sea submergence vehicles, missile launch tube closures, and the like. Edge attachment configurations or devices heretofore known for sealing and supporting spherical shell segments subjected to substantial external pressure loading, may produce unacceptably high bending (radial shear) stresses in the shell near the supporting edge, rendering the shell segment susceptible to failure.

The novel spherical shell segment edge attachment of the present invention substantially reduces in critical importance the foregoing problems associated with spherical closures, particularly as applied to spherical closures for missile launch canisters. The present invention provides, near the periphery of the shell segment, means to substantially eliminate radial shear stresses and bending stresses normally existing under external loading at the peripheral joint of the shell segment with its supporting structure. In the preferred configuration as described herein, this is accomplished by providing a flexible, low friction circumferential bearing joint to support the shell segment, the geometric configuration of which converts the bearing forces existing at the periphery of the segment under load, to a substantially tangential resultant, thereby substantially eliminating radial stresses.

It is, therefore, an object of the present invention to provide an improved spherical shell segment edge attachment.

It is a further object of this invention to provide an improved spherical segment edge attachment to reduce radial shear stresses in the spherical segment edge.

It is yet another object of the present invention to provide an improved spherical shell segment closure for a missile launch canister.

These and other objects of the present invention will become apparent as the detailed description of certain embodiments thereof proceeds.

SUMMARY OF THE INVENTION

In accordance with the foregoing principles and objects of the present invention, an improved peripheral closure joint for sealing spherical shell segments to a supporting structure therefor is provided which comprises a generally frustoconical member having an annular groove on the smaller circumference thereof for receiving the peripheral edge of the shell segment, and means on the outer periphery thereof for engaging the supporting structure without slippage, said means including a plurality of annular corrugations on the peripheral edge of said frustoconical member and mating corrugations on a supporting surface of said structure to allow said member limited rolling engagement with said surface as said member flexes under an applied load. The frustoconical member is preferably configured to transmit the applied load substantially perpendicular to said surface, and tangent to the spherical shell.

DESCRIPTION OF THE DRAWINGS

The present invention will be more clearly understood from the following detailed description of specific embodiments thereof read in conjunction with the accompanying drawings wherein.

DETAILED DESCRIPTION

Figure 1:
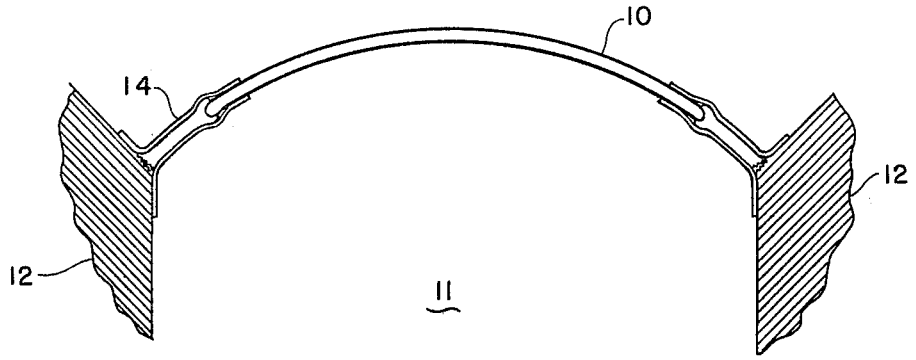
FIG. 1 is a side sectional view of a typical spherical shell section and support structure including the novel spherical segment edge attachment of the present invention.

Referring now to the drawings, FIG. 1 illustrates schematically in cross-section a dome-shaped spherical shell section supported on the periphery thereof by the novel edge attachment of this invention. The edge attachment is shown in more detail in the partial view of FIG. 2.

As shown in FIG. 1, the spherical shell segment 10 may comprise a closure or seal for a cylindrical cavity 11 defined by a tubular member or structure 12. As discussed above, typical applications of the segmented spherical shell 10 may include a protective cover for a missile launch canister or the like. Materials which shell segment 10 may comprise include glass, plastics, fiberglass, metals, ceramics, and the like, and are therefore not limiting of the invention herein. In order to be compatible with the edge attachment hereinafter described in detail, the spherical shell segment 10 has a suitable peripheral edge configuration such as shown in detail in FIG. 2 as rounded peripheral edge 13.

Figure 2:
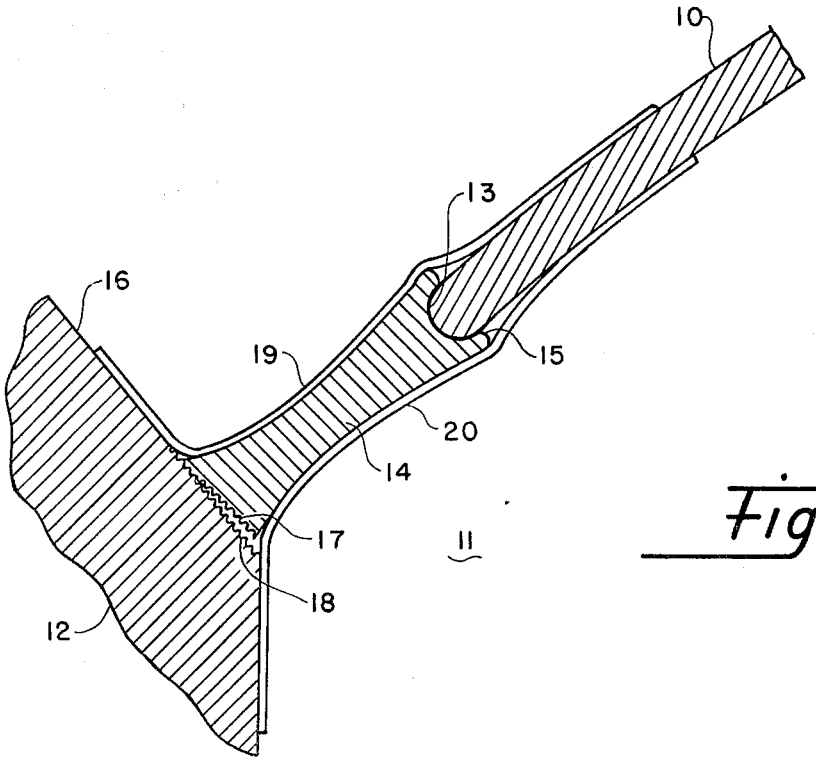
FIG. 2 is an enlargement of a portion of FIG. 1 showing in greater detail a representative embodiment of the edge attachment of this invention.

The novel edge attachment of the invention herein, as illustrated in one embodiment in FIG. 2, may comprise a frustoconical ring member 14 having around its inner edge an annular groove 15 to receive the rounded edge 13 of spherical shell segment 10, and to serve as a low friction bearing surface therefor. Certain materials herein contemplated for comprising shell segment 10, such as glass, may be supported in a manner resulting in significant bending stresses near the point of support. Therefore, in the novel edge attachment described herein, it is contemplated that the coefficient of friction at the interface of peripheral edge 13 with annular groove 15 shall be less than about 0.3 in order to substantially eliminate radial stresses at that joint. For the aforementioned materials contemplated for use, a coefficient of friction of or less than about 0.05 should be easily obtainable. Suitable material selection for ring 14 will both minimize friction at the interface of annular groove 15 with edge 13 of spherical shell segment 10, and provide a deflection under an applied load which is substantially identical with that experienced by shell segment 10. Ring member 14 may preferably be constructed to join shell segment 10 to provide a substantially continuous arcuate configuration, and, further, may be of any size consistent with the size of cavity 11 defined by structure 12 to be protected. Further, material selection for ring member 14 is not limiting hereof so long as it shall have sufficient strength to support spherical shell segment 10 as described.

Ring member 14 has on its peripheral edge means to engage structure 12 without slippage of ring member 14 on conical surface 16 of structure 12. As shown in FIG. 2, this means may include a plurality of concentric annular grooves, serrations or corrugations 17 on the peripheral edge of ring member 14 configured to mesh with a mating set of corrugations 18 on the surface 16 of structure 12. The corrugations 18 may be provided in surface 16 itself or in a plate (not shown) or the like which may be rigidly attachable conventionally to conical surface 16. The peripheral edge of frustoconical ring member 14 is preferably configured with a generally rounded contour having an outer edge radius (containing the annular grooves 17) to permit ring member 14 to exhibit a small degree of rolling engagement with surface 16 as it flexes axially under the force exerted by the weight of spherical shell segment 10 and any additional load placed thereon. This interaction of parts minimizes bearing stress deformation by maintaining as near as practicable a resultant force perpendicular to surface 16 as ring 14 flexes under the applied force. In the preferred configuration, conical surface 16 of structure 12 supporting corrugations 18 will be constructed to be substantially perpendicular to the ring member 14 near their intermeshing surfaces.

Pressure sealing of the respective annular joints between shell segment 10, ring member 14, and surface 16 may be effected conventionally by such as a pair of adherent flexible annular coverings 19 and 20, respectively covering the outer and inner surfaces of segment 10 and ring 14 with suitable sealing against structure 12. The material selection and configuration for coverings 19 and 20 will depend upon the applied pressure, medium, acceptable leakage, and other environmental factors to which the assembly is subjected.

The cross-sectional configuration of ring member 14 is such that applied pressure loading on the spherical segment 10 will overcome any friction at the interface of edge 13 and annular groove 15, allowing segment 10 to slip freely with respect to the ring member 14. This results in minimum shear stresses within segment 10 at or near its edge. Then, neglecting rolling friction between ring member 14 and surface 16, the resultant of symmetric loading on the spherical segment is therefore nearly tangent to the spherical segment. For non-symmetric loadings, ring 15 will deflect androll on surface 16 to a greater or lesser degree around the periphery of ring 15 depending on the distribution of the loading.

The present invention, as hereinabove described, therefore provides an improved spherical segment edge attachment for supporting and sealing a spherical shell segment on a supporting tubular structure. It is understood that certain modifications to the invention and material substitutions may be made, as might occur to one with skill in the field of this invention, within the scope of the appended claims. Therefore, all embodiments contemplated hereunder have not been shown in complete detail. Other embodiments may be developed without departing from the spirit of this invention or from the scope of the appended claims.

I claim:

1. An edge attachment for supporting on an annular supporting surface a spherical shell segment, which comprises:

a. a generally frustoconical member having on its inner edge an annular groove for receiving the peripheral edge of said shell segment;

b. said member having a generally rounded peripheral edge including means for rolling engagement with said supporting surface, said means comprising a plurality of concentric annular corrugations on the peripheral edge of said member and a plurality of mating corrugations on said support surface.

2. The edge attachment as recited in claim 1 wherein said frustoconical member is substantially perpendicular to said support surface at their contacting surfaces.

3. The edge attachment as recited in claim 1 wherein the coefficient of friction between the surface defining said annular groove and the surface defining the peripherical edge of said shell segment is less than about 0.3.

* * * * *